United States Patent [19]

Fahey

[11] Patent Number: 4,689,898

[45] Date of Patent: Sep. 1, 1987

[54] RUNNING SHOE

[76] Inventor: Brian W. Fahey, 1620 Cornell Dr., SE., Albuquerque, N. Mex. 87106

[21] Appl. No.: 774,785

[22] Filed: Sep. 11, 1985

[51] Int. Cl.[4] ..... A43B 13/38; A43B 7/22

[52] U.S. Cl. ..... 36/43; 36/44; 36/88; 36/91; 128/585; 128/586

[58] Field of Search ..... 36/88, 89, 91, 92, 93, 36/114, 10, 28, 29, 30 R, 31, 32 R, 43, 44, 58.5; 128/585, 586, 595, 607, 610, 614; 2/239

[56] References Cited

U.S. PATENT DOCUMENTS

| | | | |
|---|---|---|---|
| Re. 31,173 | 3/1983 | Daswick | 36/30 R |
| 294,174 | 2/1884 | Williams | 36/30 R |
| 1,730,466 | 10/1929 | Mauott | 36/44 |
| 1,743,689 | 1/1930 | Scroggins | 36/99 |
| 1,958,097 | 5/1934 | Shaw | 128/585 |
| 2,008,207 | 7/1935 | Greenberg | 36/43 |
| 2,415,459 | 2/1947 | Buselmeier | 36/11.5 |
| 2,760,281 | 8/1956 | Cosin | 36/71 |
| 2,862,313 | 12/1958 | Jones | 128/586 |
| 3,008,250 | 11/1961 | Herunter | 36/99 |
| 3,968,577 | 7/1976 | Jackson | 36/43 |
| 4,003,146 | 1/1977 | Meier et al. | 36/44 |
| 4,020,569 | 5/1977 | Fuxuoka | 36/30 R |
| 4,020,570 | 5/1977 | Shames | 36/44 |
| 4,085,527 | 4/1978 | Riggs | 36/114 |
| 4,124,946 | 11/1978 | Tomlin | 36/43 |
| 4,128,950 | 12/1978 | Bowerman et al. | 36/30 R |
| 4,133,118 | 1/1979 | Khalsa et al. | 36/83 |
| 4,155,180 | 5/1979 | Phillips | 36/129 |
| 4,180,924 | 1/1980 | Subotnick | 36/129 |
| 4,187,619 | 2/1980 | Gibbs | 36/10 |
| 4,187,620 | 2/1980 | Selner | 36/28 |
| 4,224,750 | 9/1980 | Delport | 36/91 |
| 4,241,524 | 12/1980 | Sink | 36/102 |
| 4,245,408 | 1/1981 | Larsen et al. | 36/50 |
| 4,258,480 | 3/1981 | Famolare, Jr. | 36/91 |
| 4,305,212 | 12/1981 | Coomer | 36/80 |
| 4,322,895 | 4/1982 | Hockerson | 36/129 |
| 4,338,734 | 7/1982 | Schwartz | 36/44 |
| 4,342,158 | 8/1982 | McMahon et al. | 36/7.8 |
| 4,348,821 | 9/1982 | Daswick | 36/103 |
| 4,354,319 | 10/1982 | Block et al. | 36/114 |
| 4,364,188 | 12/1982 | Turner et al. | 36/31 |
| 4,366,634 | 1/1983 | Giese et al. | 36/114 |
| 4,393,605 | 7/1983 | Spreng | 36/114 |
| 4,399,620 | 8/1983 | Funck | 36/32 R |
| 4,402,146 | 9/1983 | Parracho et al. | 36/129 |
| 4,404,759 | 9/1983 | Dassler | 36/129 |
| 4,411,077 | 10/1983 | Slavitt | 36/89 |
| 4,439,936 | 4/1984 | Clarke et al. | 36/102 |
| 4,453,322 | 6/1984 | Marsh | 36/11.5 |

FOREIGN PATENT DOCUMENTS

| | | | |
|---|---|---|---|
| 61951 | 5/1968 | Fed. Rep. of Germany | 36/43 |
| 1115805 | 4/1956 | France | 36/43 |
| 1209020 | 2/1960 | France | 128/610 |
| 2250266 | 5/1975 | France | 36/30 R |
| 2500278 | 8/1982 | France | 36/93 |
| 169273 | 11/1959 | Sweden | 36/11.5 |
| 117762 | 12/1926 | Switzerland | 36/10 |
| 706557 | 3/1954 | United Kingdom | 36/10 |
| 2011243 | 7/1979 | United Kingdom | 36/43 |

OTHER PUBLICATIONS

"Running-Shoe Technology Picks Up The Pace", High Technology/Mar. 1985, pp. 28–34.

*Primary Examiner*—Werner H. Schroeder
*Assistant Examiner*—Steven N. Meyers
*Attorney, Agent, or Firm*—Townsend & Townsend

[57] ABSTRACT

A running shoe structure which complements the natural shock absorption function of the arches of the foot by redirecting downward forces through the foot both forward and backward during running and preventing the shortening and bunching up of the feet on impact by simultaneously absorbing vertical thrust and controlling excessive lateral motion. A first raised bar in the inner sole immediately in front of the heel serves to hold the heel back while allowing the rest of the foot to roll and pivot over this bar and to stretch forward away from the heel. Medial and lateral arch supports are provided along the two sides of the shoe to keep the mid-portion of the foot lengthened by preventing compression of the medial and lateral arches in the foot. A second raised bar is located immediately in front of the heads of the metatarsals. An outer sole mirrors the shape of the inner sole and with a is secured with a cleating connection to the mid sole. A fabric inner slipper is fastened to the upper portion of the shoe to mold the shoe to the shape of the foot.

15 Claims, 8 Drawing Figures

RUNNING SHOE

BACKGROUND OF THE INVENTION

This invention relates to running shoe designs.

Historically, shoes have been designed for comfort and style with little concern for their effect on the biomechanics of the legs and feet. Recently, considerable emphasis has been placed on the development of improved shoes for running. Manufacturers of shoes have developed new combinations of materials and structures to improve cushioning, support, stability, flexibility, durability, and reduce weight.

Many shoe designs attempt to improve the support and stability given to a person's foot by conforming the shape of the inner sole to the shape of the bottom of the foot. For example, in U.S. Pat. No. 4,124,946 to Tomlin, the inner sole includes depressions for the heel and big toe and ridges under the arch of the foot and the area in front of the head of the metatarsals where the toes are joined with the remainder of the foot. A similar design for cradling the foot is shown in U.S. Pat. No. 4,133,118 to Khalsa, et al.

Other design features, instead of merely improving the support of the foot while standing, assist the rolling movement of the foot during running. For example, U.S. Pat. No. 4,348,821 to Daswick shows a rounded heel portion of the outer sole which enhances the original rolling motion of the heel after it strikes the ground. In addition, Daswick shows a second rounded portion of the outer sole which provides a second pivot point for the mid-portion of the foot to enable the mid-point of the foot to transform from a flat position to a take-off position by pivoting around this rounded portion. Other designs enchance the flexibility of the toe area to enable the bending of the foot in this area upon take-off.

Other designs of the outer soles of running shoes have been developed to increase traction while also improving resiliency and cushioning. Waffle and other patterns both improve traction due to the shape of the surfaces and increase cushioning by forming air pockets between the outer sole and the ground. A great deal of emphasis has gone into developing materials which have these properties. Shoe designs usually involve a compromise of features, such as a trade-off between cushioning and stability.

SUMMARY OF THE INVENTION

The present invention is a running shoe structure which complements the natural shock absorption function of the arches of the foot. This is accomplished by redirecting downward forces from the leg to the foot both forward and backward during running. the redirection of these forces helps prevent the shortening and bunching up of the feet on impact by simultaneously absorbing vertical thrust and controlling excessive lateral motion. A raised bar in the inner sole immediately in front of the heel serves to hold the heel back while allowing the rest of the foot to roll and pivot over this heel bar and to stretch forward away from the heel. Medial and lateral arch supports are provided along the two sides of the shoe to keep the mid-portion of the foot lengthened by preventing compression of the medial and lateral arches in the foot. In addition, these arch supports in the inner sole prevent the foot from rolling to one side or the other.

A second raised bar is located immediately in front of the head of the metatarsals where the toes join the remainder of the foot. This toe bar again serves to prevent the mid-portion of the foot from compressing into the toes, thereby keeping the foot lengthened. Individual saddle depressions for each of the toes are provided in the toe bar, with ridges in between to keep the toes separated. The saddles and ridges prevent the toes from bunching together, thereby ensuring a maximum balanced position of the toes at each foot plant and push-off.

The above features inhibit pronation and supination of the foot at the source and can be modified to counteract the effect of pronation and supination. Pronation is essentially the bending inward of the ankle when the foot strikes the ground and supination basically is the bending outward of the ankle when the foot strikes the ground. Pronation or supination result when the downward forces from the leg on impact with the ground become laterally directed. By directing the forces backward and forward from the feel to the toes through the lengthening and force-redirecting aspects of the above features, proper spacing of the bones is maintained and pronation or supination is inhibited at its source. In addition, the bars and arch supports could be higher on the inside, or medial side, of the shoe to counteract the effects of pronation, or they could be raised on the outside, or lateral side, of the shoe to counteract supination.

The structure of the inner sole is matched by a corresponding structure of the outer sole. The outer sole has arches beneath the two bars in the inner sole to enhance their effect. As the foot pivots across each of the bars, the corresponding arch in the outer sole will flatten, enhancing this pivoting and lengthening movement. Similar arches mirror the medial and lateral arch supports. A cleating connection of the outer sole to the remainder of the shoe is used to prevent slippage with respect to the various layers of the sole. This connection ensures that the action of the outer sole is coordinated with the action of the inner sole.

The movement of the upper portion of the foot is controlled to coordinate with the movement of the sole of the foot with an inner slipper made with a cotton fabric which molds to the shape of the foot. This inner slipper has its own set of eyelets which are interlaced with the eyelets of the normal outer portion of the shoe. This has the effect of reducing the motion of the foot relative to the shoe by molding the top portion of the shoe to the shape of the foot. In addition, a pair of ankle straps attach this inner slipper to the outer heel portion of the shoe to prevent the heel from lifting away from the shoe on push-off. These straps can be adjusted to be tighter on one side or the other to counteract pronation or supination.

For a further understanding of the invention, reference should be made to the ensuing detailed description taken in conjunction with the accompanying drawings.

DETAILED DESCRIPTION OF THE PREFERRED EMBODIMENTS

The present invention is a shoe design which incorporates a unique force-directing system to insure the most efficient placement of the foot during running. This force-directing system allows an appropriate transmission of force to move through the ankle, lower leg, knee, thigh, and hip. The design enhances and complements the natural structural integrity of the feet and legs and the basic mechanical actions of the foot and legs during running. An understanding of the structure of the foot and legs is essential to an understanding of the present invention.

Figure 1:
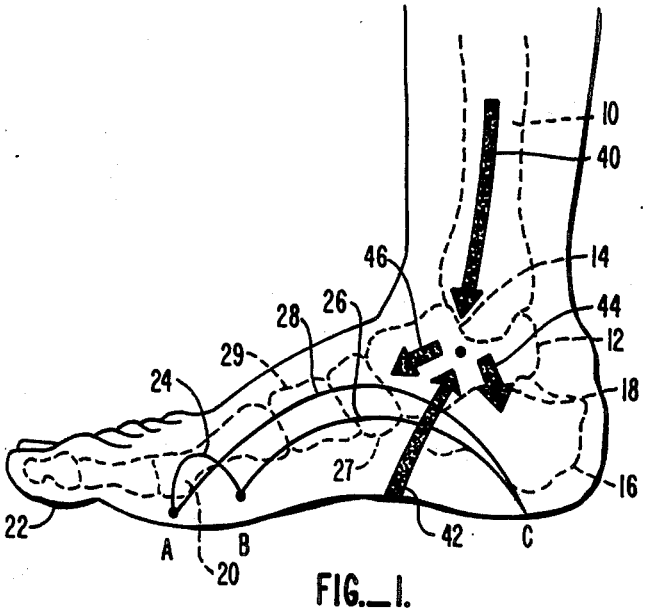
FIG. 1 is a side view of the medial aspect of a human foot showing the internal bone structure.

FIG. 1 shows the bone structure of the human foot. The bones of the lower leg are the tibia 10 and the fibula which is obscured by the view of FIG. 1. The fibula is parallel to the tibia on the other side of the tibia. The tibia is coupled to the talus bone 12 at a tibio-talus joint 14. Talus 12 is coupled to the calcaneus bone 16 at a talo-calcaneus joint 18. Talus 12 is coupled through navicular and cuboid bones to five metatarsal bones, of which a first metatarsal 20 can be seen from the view of FIG. 1. Talus 12 is coupled to cuboid bone 27 which is coupled to cuneiform bone 29. First metatarsal 20 is coupled to the bones of a big toe 22, and the remaining metatarsals are coupled to the bones of the remaining toes.

Figure 2:
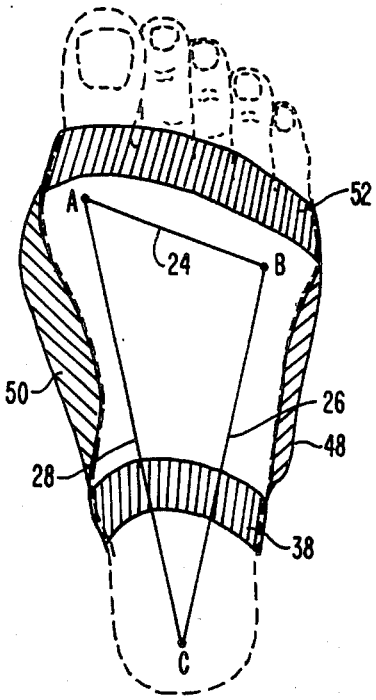
FIG. 2 is a top view of a human foot superimposed over a diagram of the points of contact with the inner sole of a preferred embodiment of the present invention.

The bones of the foot and the soft tissue of the foot form a shock-absorber system called the plantar vault. The plantar vault is supported by three arches, an interior arch 24, a lateral arch 26, and a medial arch 28. These arches are supported at points A, B, and C, which are also shown in FIG. 2. An ideal running shoe design should allow the arches of the foot and the plantar vault to maintain their ideal curvatures. A shoe design which interferes with the ideal curvatures of these arches and the plantar vault will impair the support, movement, and overall efficiency of the body in running. For a person with imbalanced foot structure, a proper shoe design may provide a corrective action to more closely approximate the ideal curvatures of the arches and the plantar vault.

Figure 3:
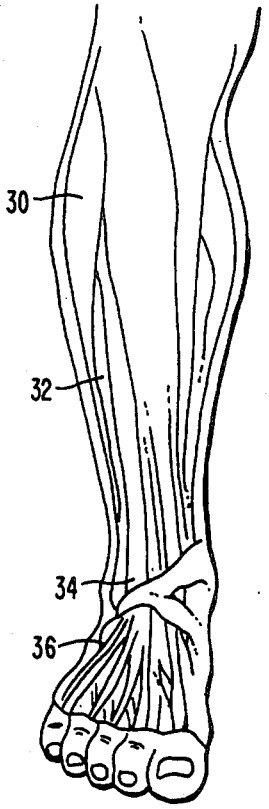
FIG. 3 is a front view of a human lower leg and foot showing the muscle structure.

FIG. 3 shows the muscles of the lower leg and foot. The way in which the bottom of the foot is supported by a running shoe will affect the amount of tension placed on these muscles, causing the muscles on one side or the other to lengthen or shorten. This lengthening or shortening of the muscles will affect the curvature of the arches of the foot during running. On the outside of the leg are the perroneal muscles; a perroneus longus muscle 30, a perroneus brevis muscle 32, and a perroneus tertius muscle 34. Perroneus tertius muscle 34 is connected to the foot through tendon 36. If the foot during running is allowed to roll to the outside, these muscles will become fibrous and overstretched and be subject to increased tension, resulting in supination of the foot. Supination is basically the rolling of the foot outward during running and pronation is basically the rolling of the foot inward during running.

The design of the present invention is intended to direct the force of the lower leg downward during running from a point of contact C of FIG. 2 forward, evenly balanced through the zone formed by the triangle between points A, B, and C. The first element of the design which effects this redirecting of force is a raised portion of the inner sole forming heel bar 38 of FIG. 4. The position of heel bar 38 is also superimposed on the foot of FIG. 2. Heel bar 38 is placed to intercept the downward force 40 as shown in FIG. 1 by presenting an opposing force 42. Downward force 40 is redirected into a rearward force 44 and a forward force 46. These forces are redirected at talus bone 12. Thus, heel bar 38 serves to keep the foot extended by preventing the heel from bunching forward with the rest of the foot. This can be considered as a simulation of running uphill at a slight incline. Heel bar 38 helps prevent pronation or supination at its source. Although the effect of pronation is seen farther forward in the foot, it is caused by a shortening of the Achilles tendon and a bunching forward of the calcaneus. Heel bar 38 is preferably formed with the material having sufficient rigidity to prevent more than 50% compression from a pressure exerted by a person's foot while running.

Without this redirection of the downward forces, initial-impact injuries can result, such as fascial strain, shin splints, and Achilles problems. In addition, without the redirection of the downward forces and a corresponding lengthening of the foot, foot misalignment, random motion, and a subsequent inappropriate direction of force to the rest of the foot's running action can result.

Figure 4:
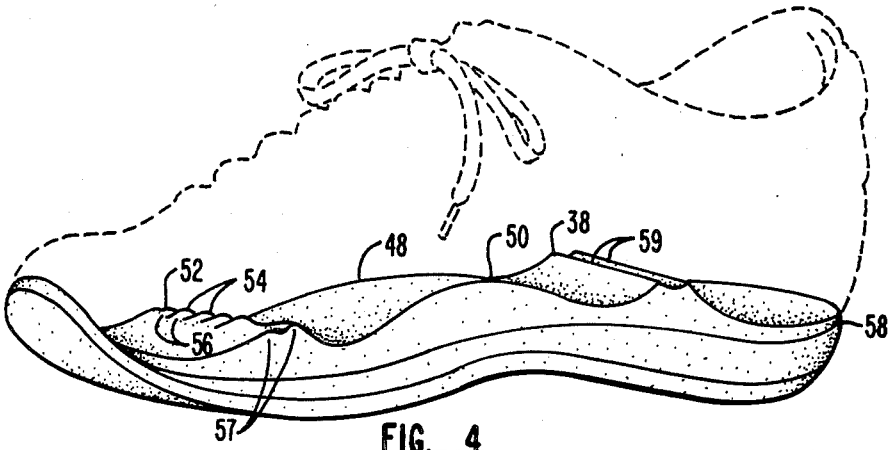
FIG. 4 is a perspective view, partially broken away, of a preferred embodiment of a shoe according to the present invention.

As shown in FIGS. 2 and 4, the mid-portion of the foot is cradled between a lateral arch support 48 and a medial arch support 50. These arch supports maintain the integrity of lateral arch 26 and medial arch 28 of the foot as shown in FIG. 1, respectively. This support prevents the arches from shortening or compressing, thereby maintaining the lengthened and balanced structure of the foot.

Lateral arch support 48 keeps the foot from rolling too far to the outside by encouraging the perroneal muscles (brevis, longus, tertius) to stay balanced in the appropriate anatomical position and not overwork. Overuse of these muscles will throw off a keystone stability point of the foot at the tibio-talus and calcaneo-cuboid joints (as shown by arrow 42 of FIG. 1). If these become unstable the overworked perroneal muscles will inevitably draw the foot into a supinated position.

As shown in FIG. 4, medial arch support 50 continues to subtly direct the foot's motion. The slightly inclined medial arch support 50 makes that part of the foot lengthen. This inhibits pronation while strongly supporting the transmission of force forward through the plantar tendon and halluces muscles and through the first and second metatarsals, where the force transmitting action is picked up and enhanced by a toe bar 52. The action encouraged by the slightly inclined medial arch support 50 can be likened to the movement that part of the foot would make naturally, if a person were stepping sideways up an inclined surface. The medial arch is flexed around its longitudinal axis in a slightly upward direction.

Toe bar 52 is provided immediately forward of the heads of the first through fifth metatarsals, as can be seen in FIGS. 2 and 4. Toe bar 52 prevents the midportion of the foot from compressing the toes, thereby maintaining the lengthened position of the foot. The toes are prevented from being compressed together by a series of ridges 54 which form corresponding saddles 56. Toe bar 52 is formed from material having sufficient rigidity to prevent more than 50% compression from pressure during running.

Bars 38 and 52 and arch supports 48 and 50 are formed as part of an inner sole 58. Heel bar 38 is preferably made of a moldable EVA (ethylene, vinyl, acetate) foam with some solid rubber content for stability. The height of heel bar 38 is between $\frac{1}{2}$ and $\frac{3}{4}$ inch compared to an average height of $\frac{1}{4}$ inch of the remainder of inner sole 58. The forward to rearward width of bar 38 near its base is preferably approximately one inch.

Bar 38 also has a pair of ridges 59 running along its upper portion. These ridges 59 enhance the rolling motion of the foot from the heel forward across bar 38. The most rearward of the ridges 59 will bend forward into the depression between the ridges as the foot rolls forward, aiding the pivoting action of the foot.

The design can be modified to help compensate for pronation or supination. For a pronating runner, the lateral side of bar 38 has a height of $\frac{1}{2}$ inch and a forward to rearward thickness of $\frac{3}{4}$ inch, while the medial side has a height of $\frac{3}{4}$ inch and a forward to rearward thickness at its base of $1\frac{1}{4}$ inches. For a supinating runner, these dimensions are exactly reversed betweeen the lateral and medial sides.

Lateral arch support 48 begins as a continuation of bar 38 and extends up to bar 52. It has an apex at a position in the mid-point of the cuboid bone (shown in FIG. 1). Its inclination begins at the anterior portion of the calcaneus bone and ends at a point slightly posterior to the head of the fifth metatarsal bone. The height of lateral arch support 48 at its apex is approximately $\frac{1}{2}$–1 inch, compared to a height of $\frac{1}{4}$ inch for the non-raised portions of inner sole 58. For a pronator, the height is made approximately $\frac{1}{2}$ inch and, for a supinator, the height is made approximately one-inch.

Medial arch support 50 is structured similarly to lateral arch 48 with its apex and beginning and ending points of inclination at similar positions on the medial side of the foot. The height of the apex of medial arch support 50 corresponds to that of lateral arch support 48 with a $\frac{1}{2}$ inch height being used for supinators and a one-inch height being used for pronators. Arch supports 48 and 50 are preferably made of EVA foam of moderate density.

For people with high arches, who are likely to be supinators, lateral arch support 48 is slightly thickened while medial arch support 50 is thinned out somewhat to encourage flexibility and to direct more force through the medial arch. The medial arch actually lengthens and drops somewhat because heel bar 38 draws the heel back, thereby reducing that person's tendency to over supinate or roll excessively to the outside (lateral arch) of the foot. For runners with flatter feet and a collapsed medial arch, who are more likely to be pronators, medial arch support 50 is slightly thickened while lateral arch support 48 is thinned out appropriately. These variations keep the medial arch in its most efficient flexed shape for shock absorption and the transmission of force while reducing the tendency toward over pronation by literally cradling the foot from side to side.

Toe bar 52 preferably has a front to back thickness at its base of approximately $\frac{3}{4}$ inch. The height of toe bar 52 from its base to the bottom of a saddle 56 is approximately $\frac{1}{2}$–$\frac{3}{4}$ inch. For supinators, the height is made $\frac{1}{2}$ inch for the first three toes (starting at the big toe) and approximately $\frac{3}{4}$ inch for the last two toes. For pronators, the height is made approximately $\frac{3}{4}$ inch for the first three toes and $\frac{1}{2}$ inch for the last two toes. A pair of ridges 57 extend through saddles 56 to perform a function similar to that of ridges 59 of heel bar 38. Toe bar 52 is preferably made of a moldable EVA foam of less density and hardness than the material used for heel bar 38. In addition, some blown rubber may be used for flexibility. The separation of the toes insures that during the push-off motion of running, each of the toes will contact the ground and the toes will not be squeezed together, which would reduce the effectiveness of push-off.

In a high percentage of runners the last two toes are so smashed together that they act as one toe. This reduces push off and balance and causes the lateral margin of the foot to curl under, causing many runners to bow out at the angle joint to such an extent that they are running on the outside of the foot. This bunching also holds true for flat footed runners, but to a lesser degree. This causes lateral strain, pain, and fascial stress related problems. The tissues of the foot are overworked and become rigid and misaligned while attempting to hold the foot, ankle, and leg from bowing further. The presence of this phenomenon is shown by excessive wear on the rear and lateral aspects of the running shoe. This phenomenon also causes shortening of the medial aspect of the foot, ankle, and leg which leads to knee strain and pain, shin splints, and plantar fascitis. This bunching pattern in the toes and the rest of the foot throws off the total balance and integrity of the impact area, decreases running efficiency, and increases long term structural deterioration. Toe bar 52 encourages the toes and forefoot to reach forward and stay extended in a position affording maximum push-off during each foot placement. The toes become a natural anti-pronation/supination device if they remain supple and lengthened during each foot strike. Toe bar 52 helps to maintain this performance capability by keeping the axes of the first and fifth metatarsals and the navicular and cuboid bones more level with each other, thus ensuring a maximum balanced position at each foot plant and push off. All five toes are maintained in nearly the same plane during push-off.

Figure 5A:
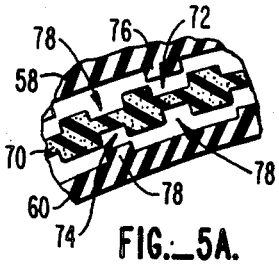
FIG. 5A is an exploded cutaway view of the sole of FIG. 5 showing the cleating connections between the inner and outer soles.
Figure 5:
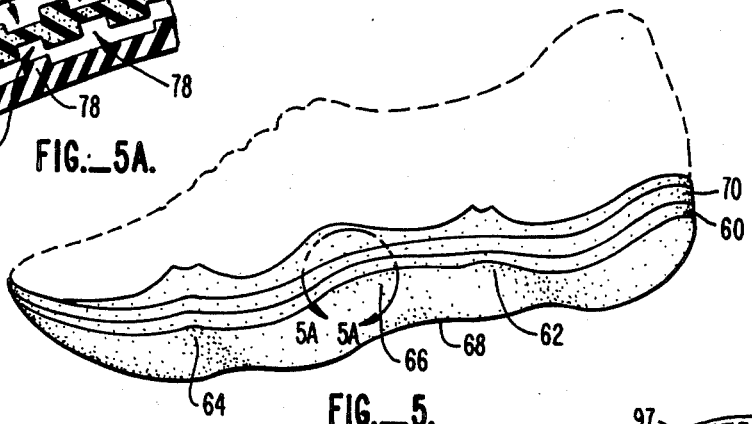
FIG. 5 is a perspective view of the shoe of FIG. 4 showing the bottom sole contours.

Referring to FIG. 5, an outer sole 60 of the shoe can be seen more clearly. Outer sole 60 has a pair of contours 62 and 64 which mirror the contours of bars 38 and 52 of insole 58. Additional contours 66 and 68 mirror the contours of arch supports 50 and 48, respectively. Outer sole 60 is made of solid rubber and is $\frac{1}{2}$–$\frac{3}{4}$ inch thick. The height of the contours is less than that of the corresponding contours of the inner sole by an order to approximately $\frac{1}{2}$–$\frac{1}{3}$. The outer sole contours complement the actions of the bars and supports of the inner sole. When the foot contacts heel bar 38 and rolls over it, contour 62 is flattened at the same time, causing the whole shoe to flatten downward at that point and lengthen, thereby enhancing the lengthening of the foot.

Outer sole 60 and inner sole 58 are bonded together with a cleating connection of a midsole 70 as shown in FIG. 5A, which is a blown up, cutaway view of a portion of the midsole of the shoe in FIG. 5. Midsole 70 has a series of recesses 72 and 74 to accommodate corresponding cleats 76 and 78 in inner sole 58 and outer sole 60, respectively. These different sole layers are shown separated to provide a better view. When the sole layers are cemented together, the cleats fits snugly into the corresponding recesses to form a secure connection of outer sole 60 to inner sole 58. A number of recesses 78 have no corresponding cleat, and thus form air spaces within the sole of the shoe to provide cushioning. This cleating connection ensures that the inner sole will always be acting on the foot in conjunction with the outer sole 60 without any slippage or movement of the soles relative to each other. The cleats are preferably made of blown rubber for increased resiliency and cushioning, while the outer sole 60 is made from solid rubber for greater durability.

Figure 6A:
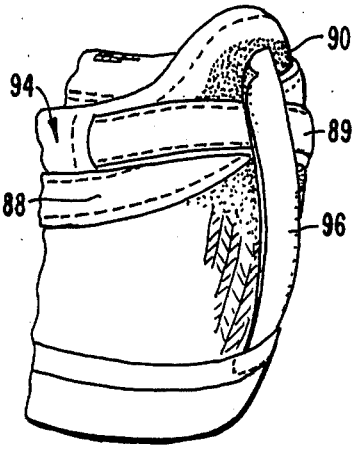
FIGS. 6 and 6A are perspective views of the shoe of FIG. 4 including the inner slipper, interlocking lace system and ankle stabilizer straps.
Figure 6:
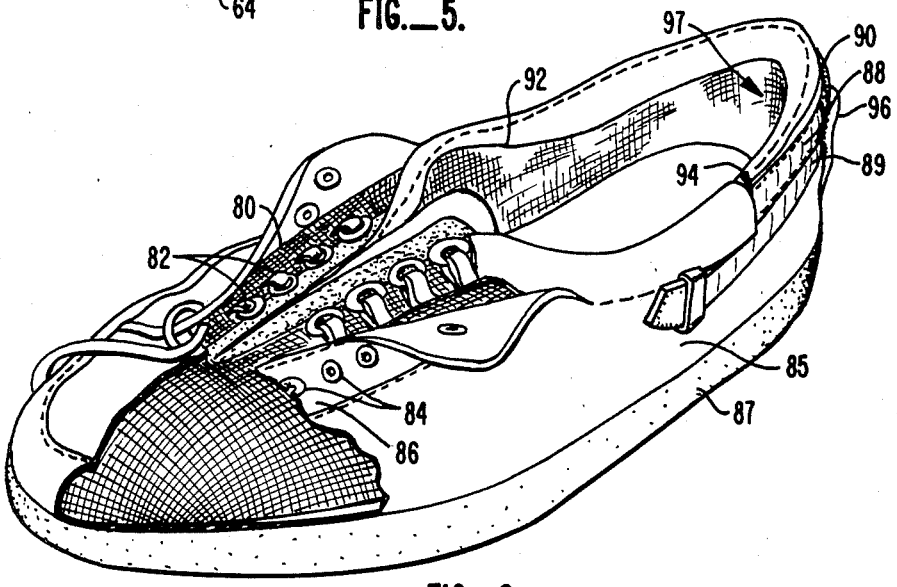

FIG. 6 shows an inner slipper 80 for use with the shoe of FIG. 4. Inner slipper 80 is made of a cotton nylon tricot which is cross-hatched with various gauges of nylon mesh. The fabric provides medium flexibility and moderate porosity. Slipper 80 gives a moccasin-like fit as it molds to the dorsal contours of the foot. A set of eyelets 82 are provided to correspond to similar eyelets 84 in the outer portion of the shoe 86. The lacing pattern formed by these eyelets allows for a more snug fit of the inner slipper 80 and the outer portion of the shoe 86 over the dorsal aspect of the foot. The inner slipper 80 ensures that the top outer portion of the foot, thereby preventing slippage of the foot relative to inner sole 58.

Slipper 80 will reduce random foot motion and stabilize the lower leg, ankle, and foot relationships during each foot placement. Only the lightest of socks will be necessary. In this way an upper section of the shoe 85 and a shoe platform 87 are more integrated and supportive of each other. Inner slipper 80 ensures a snug fit, reduces internal friction and foot temperature, and keeps the upper section of the shoe more balanced on shoe platform 88.

As can be seen by referring to FIG. 6A as well as FIG. 6, a pair of ankle straps 88, 89 are provided to further mold the shoe to the shape of the foot. These straps can attach to a VELCRO connection 90 at the back of the shoe. Straps 88, 89 are coupled to the inner slipper at a portion 92 and pass through a channel 94 in outer portion 86 of the shoe. An optional securing strap 96 covers straps 88, 89 and attaches to VELCRO 90 to strengthen the attachment of ankle straps 88, 89 to the shoe and prevent the ankle straps from slipping.

Ankle straps 88, 89 will prevent the heel of the foot from lifting off of inner sole 58 while a person is running. In addition, ankle straps 88, 89 in conjunction with the dual eyelets 82, 84, snugly secure the shoe and inner sole 58 to a person's foot.

The laces for eyelets 82 and 84 are preferably a highly elastic shock cord nylon material approximately $\frac{1}{4}$ inch thick. Ankle straps 88, 89 are wide enough to apply a corrective force to the upper portion of the ankle. Preferably, straps 88, 89 are $\frac{1}{2}$–$\frac{3}{4}$ inch wide. The tension in ankle straps 88, 89 can be adjusted separately for each side to compensate for excessive pronation or supination.

Inner straps 88 can be tightened to prevent excessive pronation and outer strap 89 can be tightened to prevent excessive supination. Ankle straps 88, 89 will also help to stabilize the heel by preventing upward lift of the foot from the shoe and by keeping the Achilles tendon lengthened, while also reducing the side to side motion in heel cup 97. Ankle straps 88, 89 are integrated with inner slipper 80 so that it binds the front and back of the shoe as well as the front and back of the foot. When securing ankle straps 88, 89 a great deal of forward tension can be applied to the forefoot and the ankle.

As will be understood by those familiar with the art, the present invention can be embodied in other forms without departing from the spirit or essential characteristics thereof. For instance, inner sole 58 could be a removable inner sole which is placed into a shoe. Accordingly, the foregoing embodiments are intended to be illustrative of, but not limiting of, the scope of the invention which is set forth in the following claims.

What is claimed is:

1. An inner sole for an article of footwear comprising a substantially planar, horizontal top surface adapted to support the bottom of a person's foot and having a raised bar extending above said top surface substantially across the width of said inner sole and arranged to contact a person's foot near the anterior surface of the calcaneus, said bar defining a substantially arcuate surface from the rear to the front of said bar so that said foot will roll over said bar during a running motion.

2. The inner sole of claim 1 wherein the height of said raised bar decreases from one side of said sole to the other.

3. The inner sole of claim 1 wherein said raised bar is formed with a material having sufficient rigidity to prevent more than fifty percent compression from a pressure exerted by a person's foot while running.

4. The inner sole of claim 1 wherein said raised bar has a width near an uppermost surface of said bar from front to rear of approximately one half its width from front to rear at a junction of said bar and said top surface.

5. The inner sole of claim 1 wherein said bar is approximately $\frac{3}{4}$ to $1\frac{1}{4}$ inch wide from front to back at a junction of said bar and said top surface, approximately $\frac{1}{4}$–$\frac{3}{4}$ inch wide near an uppermost surface of said bar from front to back, and is raised approximately $\frac{1}{4}$–$\frac{3}{4}$ inch above said top surface.

6. The inner sole of claim 1 further comprising a second raised bar adapted to extend from near the head of the first metatarsal to near the head of the fifth metatarsal of said foot, said second bar being forward of said metatarsals and defining five saddles adapted to cradle a person's toes, said saddles defining ridges adapted to separate said toes, said second bar having a width from front to rear through the top of each saddle of approximately half the width of said second bar beneath said saddle at a junction of said second bar and said top surface.

7. A sole structure for an article of footwear comprising:

an inner sole having a substantialy planar, horizontal top surface adapted to support the bottom of a person's foot;

a first raised bar extending above said top surface substantially across the width of said inner sole and arranged to contact a person's foot near the anterior surface of the calcaneus;

a second raised bar adapted to extend from near the head of the first metatarsal to near the head of the fifth metatarsal of said foot, said second bar being forward of said metatarsals and defining five saddles adapted to cradle a person's toes, said saddles defining ridges adapted to separate said toes; and an outer sole coupled to said inner sole, said outer sole having a lower surface defining a first arched channel extending across the width of said outer sole beneath said first bar and a second arched channel extending across the width of said outer sole beneath said second bar.

8. The inner sole of claim 1 further comprising an arch-shaped upward protrusion along a lateral side of said inner sole, said lateral arch being arranged to extend from near the anterior portion of the calcaneus of said foot through an apex near the middle of the cuboid to near the posterior of the head of the fifth metatarsal.

9. The inner sole of claim 1 further comprising an arch-shaped upward protrusion along a medial side of said inner sole, said medial arch being adapted to extend from near the anterior portion of the calcaneus through an apex near the middle of the cuboid to near the posterior of the head of the first metatarsal.

10. The inner sole of claim 1 further comprising a fabric insert adapted to conform to the contours of a person's foot and means for securing said fabric insert to said article of footwear and snugly conforming an upper portion of said insert to a dorsal portion of said foot.

11. An inner sole for an article of footwear comprising a substantially planar, horizontal top surface adapted to support the bottom of a person's foot and having a raised bar extending above said top surface substantially across the width of said inner sole and arranged to contact a person's foot near the anterior surface of the calcaneus, said raised bar having a pair of ridges extending along the length of said raised bar.

12. An inner sole for an article of footwear comprising a substantially planar horizontal top surface adapted to support the bottom of a person's foot and a raised bar extending above said top surface across the width of said inner sole, said raised bar being arranged to contact said foot near the anterior surface of the calcaneus, said bar having a junction with said top surface and an uppermost surface, said bar at said junction being approximately twice as wide as a portion of said bar near said uppermost surface, said bar having a height above said top surface which decreases along the length of said bar from one side of said inner sole to the other side, said bar defining a pair of ridges extending along the length of said bar, said bar being formed with a material having sufficient rigidity to prevent more than 50% compression from a pressure exerted by said foot while said person is running.

13. An inner sole for an article of footwear comprising a substantially planar, horizontal top surface adapted to support the bottom of a person's foot and having a raised bar adapted to extend from near the head of the first metatarsal of said foot to near the fifth metatarsal, said raised bar being forward of said metatarsals and defining five saddles adapted to cradle said person's toes, said saddles defining ridges to separate said toes, said bar having a width from front to rear near a top surface of each saddle of approximately half a width of said bar at a junction of said bar and said top surface beneath said saddle, the height of said saddles decreasing from one side of said inner sole to the other.

14. The inner sole of claim 1 further comprising a pair of transverse ridges extending through each of said saddles from one side of said inner sole to the other.

15. An inner sole for an article of footwear comprising a substantially planar, horizontal top surface adapted to support the bottom of a person's foot and having a raised bar adapted to extend above said top surface from near the head of the first metatarsal of said foot to near the fifth metatarsal, said bar being forward of the heads of said metatarsals and defining five saddles adapted to cradle said person's toes, said saddles defining ridges to separate said toes, said bar having a width from front to rear near a top surface of each saddle of approximately half the width of said bar at a junction of said bar and said top surface beneath said saddle, each of said saddles having a height above said top surface which decreases from one side of said inner sole to the other side, said bar being made of a material of sufficient rigidity to prevent more than fifty percent compression from the pressure of a person's foot while running, and a pair of transverse ridges extending through each of said saddles from one side of said inner sole to the other.

* * * * *